US007584798B2

(12) United States Patent
Dallas

(10) Patent No.: US 7,584,798 B2
(45) **Date of Patent: *Sep. 8, 2009**

(54) SUBSURFACE LUBRICATOR AND METHOD OF USE

(75) Inventor: L. Murray Dallas, Fairfield, TX (US)

(73) Assignee: Stinger Wellhead Protection, Inc., Oklahoma City, OK (US)

( * ) Notice: Subject to any disclaimer, the term of this patent is extended or adjusted under 35 U.S.C. 154(b) by 182 days.

This patent is subject to a terminal disclaimer.

(21) Appl. No.: 11/541,335

(22) Filed: Sep. 28, 2006

(65) Prior Publication Data

US 2008/0078558 A1 Apr. 3, 2008

(51) Int. Cl.
*E21B 23/08* (2006.01)

(52) U.S. Cl. ..... 166/383; 166/77.4; 166/85.1; 166/85.4

(58) Field of Classification Search ..... 166/77.4, 166/379, 383, 70
See application file for complete search history.

(56) References Cited

U.S. PATENT DOCUMENTS 1,586,923 A * 6/1926 Townsend ..... 166/77.4
1,895,132 A * 1/1933 Minor ..... 166/77.4
2,555,145 A * 5/1951 McKinney ..... 254/29 R
2,755,863 A 7/1956 Stansbury, Jr. et al.
3,071,190 A 1/1963 Ehlert
3,212,581 A * 10/1965 Marshall ..... 166/84.2
3,216,500 A 11/1965 Diehl
3,415,317 A 12/1968 Drivet
3,435,895 A 4/1969 Lee
3,568,767 A 3/1971 Weiss
3,732,928 A 5/1973 Sizer
3,924,686 A 12/1975 Arnold
4,153,111 A * 5/1979 Lans et al. ..... 166/377
4,452,304 A * 6/1984 Barrier et al. ..... 166/70
4,657,075 A * 4/1987 McLeod ..... 166/72
4,681,168 A 7/1987 Kisling, III
4,867,243 A * 9/1989 Garner et al. ..... 166/379
4,993,489 A * 2/1991 McLeod ..... 166/72
4,993,492 A 2/1991 Cressey et al.
5,020,590 A * 6/1991 McLeod ..... 166/77.4
5,025,857 A * 6/1991 McLeod ..... 166/77.4
5,123,356 A 6/1992 Brooks et al.
5,509,481 A 4/1996 Huber et al.
5,529,127 A 6/1996 Burleson et al.
5,568,837 A * 10/1996 Funk ..... 166/383
5,785,121 A 7/1998 Dallas (Continued)

OTHER PUBLICATIONS

U.S. Appl. No. 11/397,838, entitled "Method of Subsurface Lubrication to Facilitate Well Completion, Re-Completion and Workover," filed Apr. 4, 2006.

*Primary Examiner*—Jennifer H Gay
*Assistant Examiner*—Cathleen R Hutchins
(74) *Attorney, Agent, or Firm*—Nelson Mullins Riley & Scarborough, LLP

(57) ABSTRACT

A subsurface lubricator facilitates well completion, re-completion and workover while increasing safety and reducing expense. The subsurface lubricator includes a bi-directional packoff tool on its bottom end. Short hydraulic cylinders lubricate the subsurface lubricator into the well until the bi-directional packoff tool is in a top end of a casing of the well. High pressure fluid pumped through a side port of a wellhead of the well lubricates the subsurface lubricator into the well.

20 Claims, 10 Drawing Sheets

U.S. PATENT DOCUMENTS 5,819,851 A 10/1998 Dallas
5,848,646 A 12/1998 Huber et al.
5,857,523 A 1/1999 Edwards
5,957,198 A 9/1999 Haynes
5,988,274 A * 11/1999 Funk ..... 166/77.4
6,009,941 A 1/2000 Haynes
6,015,014 A 1/2000 Macleod et al.
6,019,175 A 2/2000 Haynes
6,056,055 A 5/2000 Falconer et al.
6,145,596 A 11/2000 Dallas
6,209,633 B1 4/2001 Haynes
6,220,363 B1 4/2001 Dallas
6,289,993 B1 9/2001 Dallas
6,328,111 B1 12/2001 Bearden et al.
6,364,024 B1 4/2002 Dallas
6,412,560 B1 7/2002 Bernat
6,491,098 B1 12/2002 Dallas
6,571,868 B2 6/2003 Victor
6,609,571 B2 8/2003 Nice et al.
6,712,147 B2 * 3/2004 Dallas ..... 166/379
6,755,244 B1 6/2004 Koopmans
6,817,423 B2 11/2004 Dallas
6,827,147 B2 * 12/2004 Dallas ..... 166/379
7,168,495 B2 1/2007 Dallas et al.
7,210,525 B2 5/2007 Dallas
2003/0221844 A1 * 12/2003 Dallas ..... 166/381
2004/0011530 A1 * 1/2004 Felthager, Sr. ..... 166/377
2004/0173347 A1 * 9/2004 Dallas ..... 166/77.1
2004/0262015 A1 * 12/2004 Mazzella et al. ..... 166/383
2005/0217868 A1 * 10/2005 Dallas et al. ..... 166/387
2007/0227744 A1 * 10/2007 Rodgers ..... 166/380

* cited by examiner

SUBSURFACE LUBRICATOR AND METHOD OF USE

FIELD OF THE INVENTION

This invention generally relates to hydrocarbon well completion, recompletion and workover and, in particular, to a subsurface lubricator and a method of using same to facilitate well completion, re-completion and workover.

BACKGROUND OF THE INVENTION

Significant advances in facilitating well completion, re-completion and workover using long downhole tool strings have been described in applicant's published co-pending patent applications US 2007/0227742 A1 and US 2007/0227743, respectively filed on Apr. 4, 2006 and respectively entitled: A Casing Transition Nipple And Method Of Casing A Well To Facilitate Well Completion, Re-Completion And Workover; and Method Of Subsurface Lubrication To Facilitate Well Completion, Re-Completion And Workover; the specifications of which are respectively incorporated herein by reference.

In view of these advances there exists a need for a subsurface lubricator that permits a long tool string to be lubricated into a well cased for subsurface lubrication.

SUMMARY OF THE INVENTION

It is therefore an object of the invention to provide a subsurface lubricator and method of using same to permit a long tool string to be lubricated into a cased wellbore.

The invention therefore provides a subsurface lubricator for lubricating a long tool string into a cased wellbore, comprising: a lubricator tube for housing the long tool string, the lubricator tube having a top end and a bottom end; a bidirectional packoff tool connected to the bottom end of the lubricator tube; and a mechanism for inducing controlled linear motion of the lubricator tube to lubricate the lubricator tube through a wellhead of the cased wellbore so that the bidirectional packoff tool is located in a top of a casing of the cased wellbore, in which location pressurized fluid can be supplied through a port of the wellhead to lubricate the lubricator tube further into the casing by applying fluid pressure to a top of the bidirectional packoff tool.

The invention further provides a method of lubricating a downhole tool string into a cased wellbore, comprising: mounting a subsurface lubricator with a lubricator tube that houses the downhole tool string above a pressure control gate mounted to a wellhead of the cased wellbore; opening the pressure control gate and lubricating a lubricator tube of the subsurface lubricator through the wellhead until a bidirectional packoff tool connected to a bottom end of the lubricator tube is located in a top of a casing of the cased wellbore; and injecting pressurized fluid through the wellhead into an annulus above the bidirectional packoff tool to lubricate the lubricator tube further into the casing.

The invention yet further provides a subsurface lubricator for lubricating a long tool string into a cased wellbore, comprising: a lubricator tube for housing the long tool string, the lubricator tube having a top end and a bottom end; a bidirectional packoff tool connected to the bottom end of the lubricator tube; and hydraulic cylinders for lubricating the lubricator tube through a wellhead of the cased wellbore so that the bidirectional packoff tool is located in a top of a casing of the cased wellbore, in which location pressurized fluid can be supplied through a port of the wellhead to an annulus above the bidirectional packoff tool to lubricate the lubricator tube further into the casing.

BRIEF DESCRIPTION OF THE DRAWINGS

Having thus generally described the nature of the invention, reference will now be made to the accompanying drawings, in which.

DETAILED DESCRIPTION OF THE PREFERRED EMBODIMENTS

The invention provides a subsurface lubricator that facilitates well completion, re-completion and workover. The subsurface lubricator is lubricated down through a wellhead of a well and into an upper section of a production casing supported by the wellhead. The subsurface lubricator permits long tool strings to be lubricated into the well while significantly reducing a distance that an injector for controlling the tool string is located above the ground after the tool string has been lubricated into the well. Expense is therefore reduced and safety is improved by lowering working height and reducing mechanical stress on the wellhead.

Figure 1:
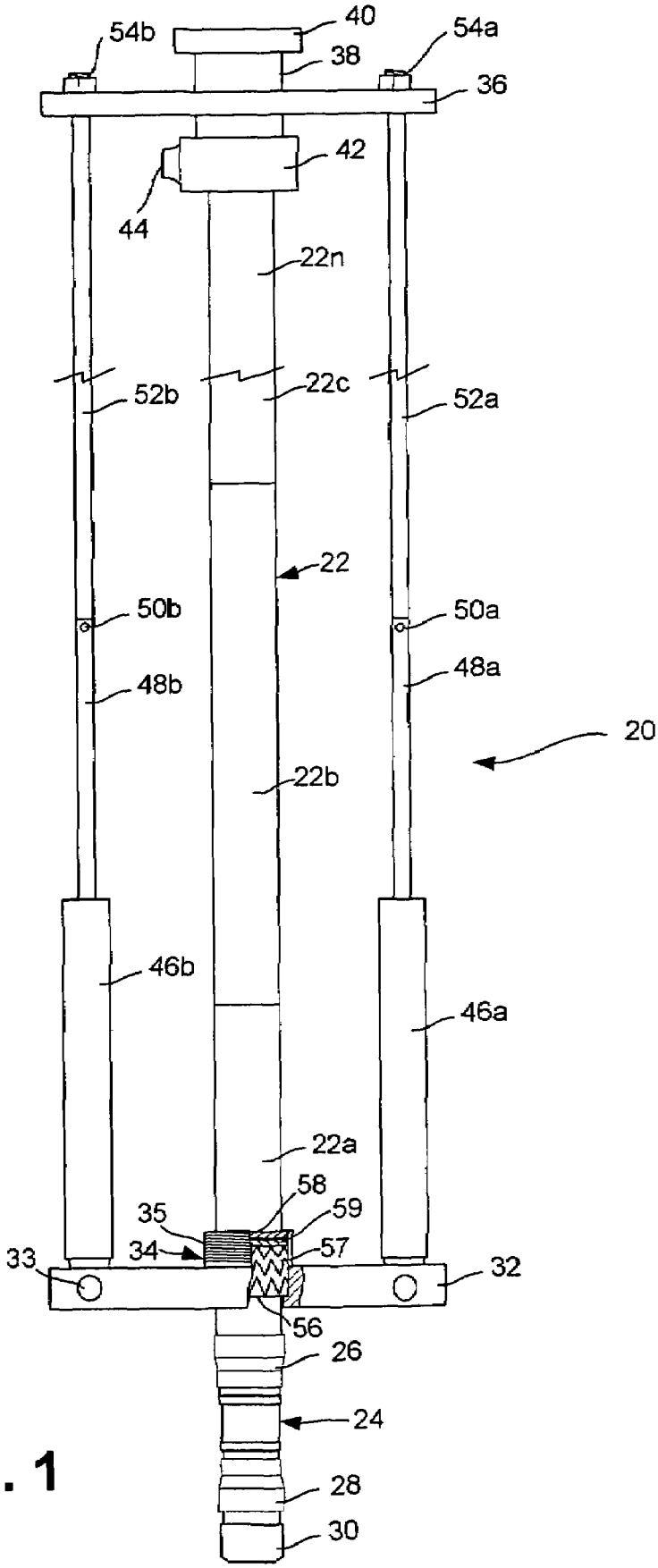
FIG. 1 is a schematic diagram of an embodiment of a subsurface lubricator in accordance with the invention.

FIG. 1 is a schematic diagram, partially in cross-section, showing an embodiment of a subsurface lubricator 20 in accordance with the invention. The subsurface lubricator 20 includes a lubricator tube 22 having a plurality of lubricator joints 22*a*, 22*b*, 22*c*, . . . 22*n*. The number of lubricator joints in the lubricator tube 22 depends on a length of the respective joints (generally 8'-10') and the length of the downhole tool string to be lubricated into a well. The lubricator joints 22*a*-22*n* are threadedly interconnected end-to-end, so that the lubricator tube 22 is a hollow cylinder with smooth cylindrical inner and outer walls. A bidirectional packoff tool 24 is connected to a bottom end of the lubricator tube 22. The bidirectional packoff tool 24 will be described in detail with reference to FIGS. 9 and 10.

The lubricator tube 22 reciprocates through a central passage in an anchor plate 32. Quick-release connectors at connection points 33 connect hydraulic cylinders 46*a*, 46*b* to the anchor plate 32. The function of the hydraulic cylinders 46*a*, 46*b* will be described with reference to FIGS. 2-8. Affixed to the top of the anchor plate 32 is an anchor pin 34. Pin threads 35 are cut into an outer periphery of the anchor pin 34. The pin threads 35 are engaged by box threads of an anchor nut 42 to lock the lubricator tube 22 in the fully lubricated-in position, as will also be explained below with reference to FIG. 5.

Threadedly connected to a top end of the lubricator tube 22 is a lubricator tube adaptor 38. The lubricator tube adaptor has a central passage that communicates with an interior of the lubricator tube 22 and has a diameter at least as large as a diameter of the lubricator tube 22. A top end of the lubricator tube adaptor 38 supports an adaptor flange 40. The adaptor flange 40 permits any compatible flanged component to be mounted to a top of the subsurface lubricator 20, such as: a high pressure valve; a blowout preventer (BOP); a frac stack; a coil tubing injector; a wireline grease injector; a coil tubing BOP; a wireline BOP; or any other appropriate equipment. A bottom end of the lubricator tube adaptor 38 includes an annular shoulder (not shown) that rotatably supports the anchor nut 42. The anchor nut 42 may be a spanner nut, or a hammer union having two or more hammer lugs 44, which are well known in the art. An injector plate 36 is connected to the adaptor 38 in a radial orientation. The injector plate 36 includes at least two connection points for respectively connecting top ends of hydraulic cylinder extension rods 52*a* and 52*b*. The extension rods 52*a* and 52*b* are connected to cylinder rods 48*a* and 48*b* by quick-release connectors 50*a* and 50*b*. The top end of each extension rod 52*a*, 52*b* is connected at the connection points of the injector plate 36 by a respective fastener 54*a* and 54*b*, such as a spanner nut or a quick-release connector.

The anchor pin 34 and the anchor plate 32 are shown partially in cross-section to illustrate part of an annular packing cavity 56 that surrounds the lubricator tube 22. The packing cavity 56 accepts a high-pressure packing 57, such as chevron packing, which is well known in the art. The high-pressure packing 57 is retained in the packing cavity 56 by packing nut 58. A packing wedge 59 is a V-shaped steel ring that compresses the high-pressure packing 57 in the packing cavity 56 when the packing nut 58 is tightened.

Figure 2:
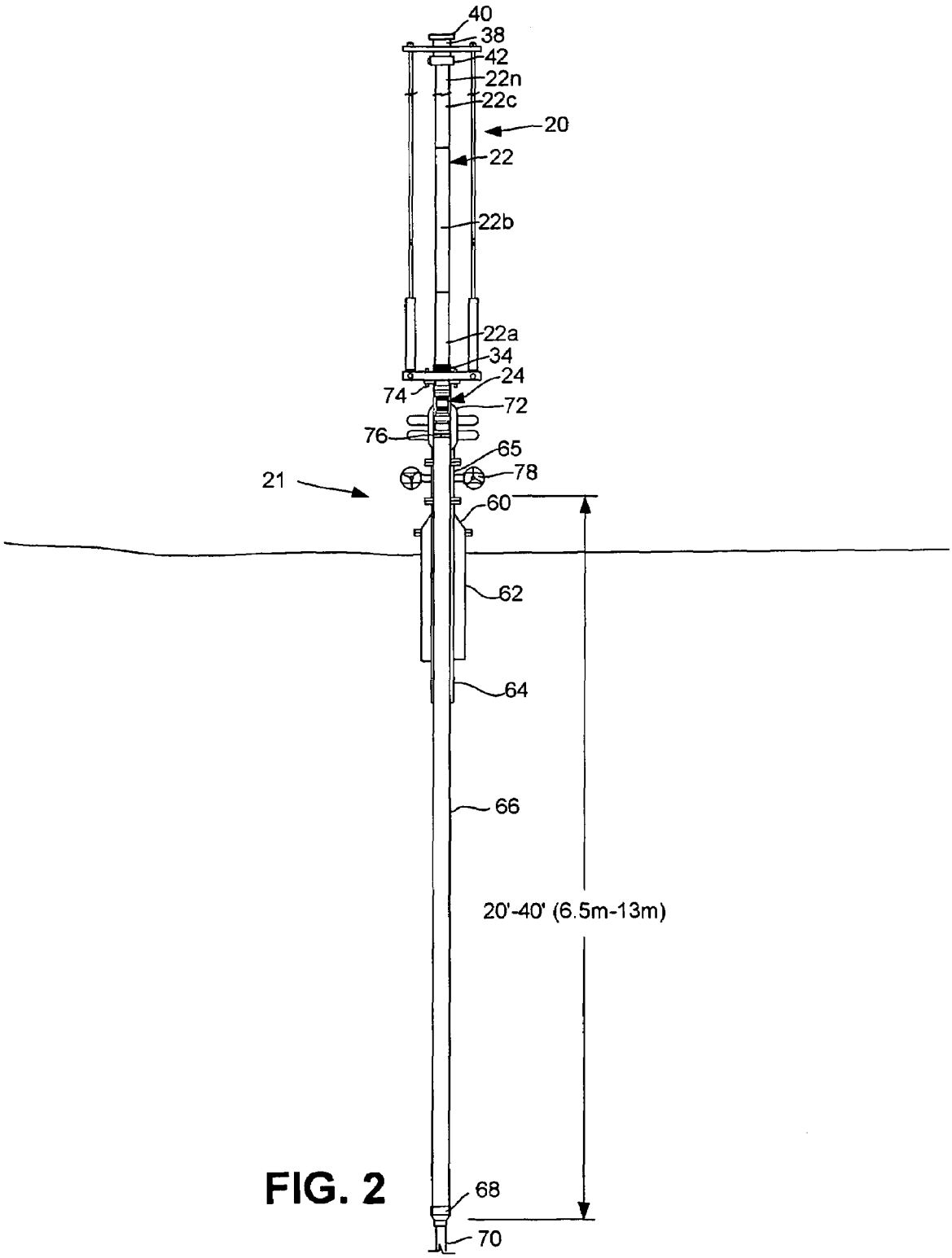
FIG. 2 is a schematic diagram of the subsurface lubricator shown in FIG. 1 mounted to a well cased for subsurface lubrication.

FIG. 2 is a schematic diagram of the subsurface lubricator 20 mounted to a wellhead 21 of a well cased as described in applicant's above-referenced patent application US 2007/0227742 A1. The wellhead includes a casing head 60 supported by a conductor 62. The casing head 60 supports a surface casing 64. A tubing head spool 65 is mounted to the casing head 60. The tubing head spool 65 supports a production casing 66 of a first diameter, which extends downwardly to a casing transition nipple 68. The casing transition nipple supports a production casing 70 of a second, smaller diameter. The production casing 70 extends downwardly through the production zone(s) of the well. As will be understood by those skilled in the art, the subsurface lubricator 20 and the long tool string that it houses is generally made up on the ground and then hoisted into place using a rig or a crane (not shown). As will also be understood by those skilled in the art, mounted to a top of the subsurface lubricator 20 will be at least a coil tubing injector or a wireline grease injector (neither of which is shown) for suspending and manipulating the downhole tool string. Reference may be made to applicant's above-identified co-pending patent applications for a more detailed explanation.

Generally, the subsurface lubricator 20 is mounted to a top of a pressure control gate, such as to the top of a blowout preventer 72 using flange bolts 74 and a metal ring gasket (not shown), which is well known in the art. If the well is a live well, blind rams 76 of the blowout preventer 72 are closed to prevent any escape of hydrocarbons from the well while the subsurface lubricator 20 is mounted to the blowout preventer 72.

Figure 3:
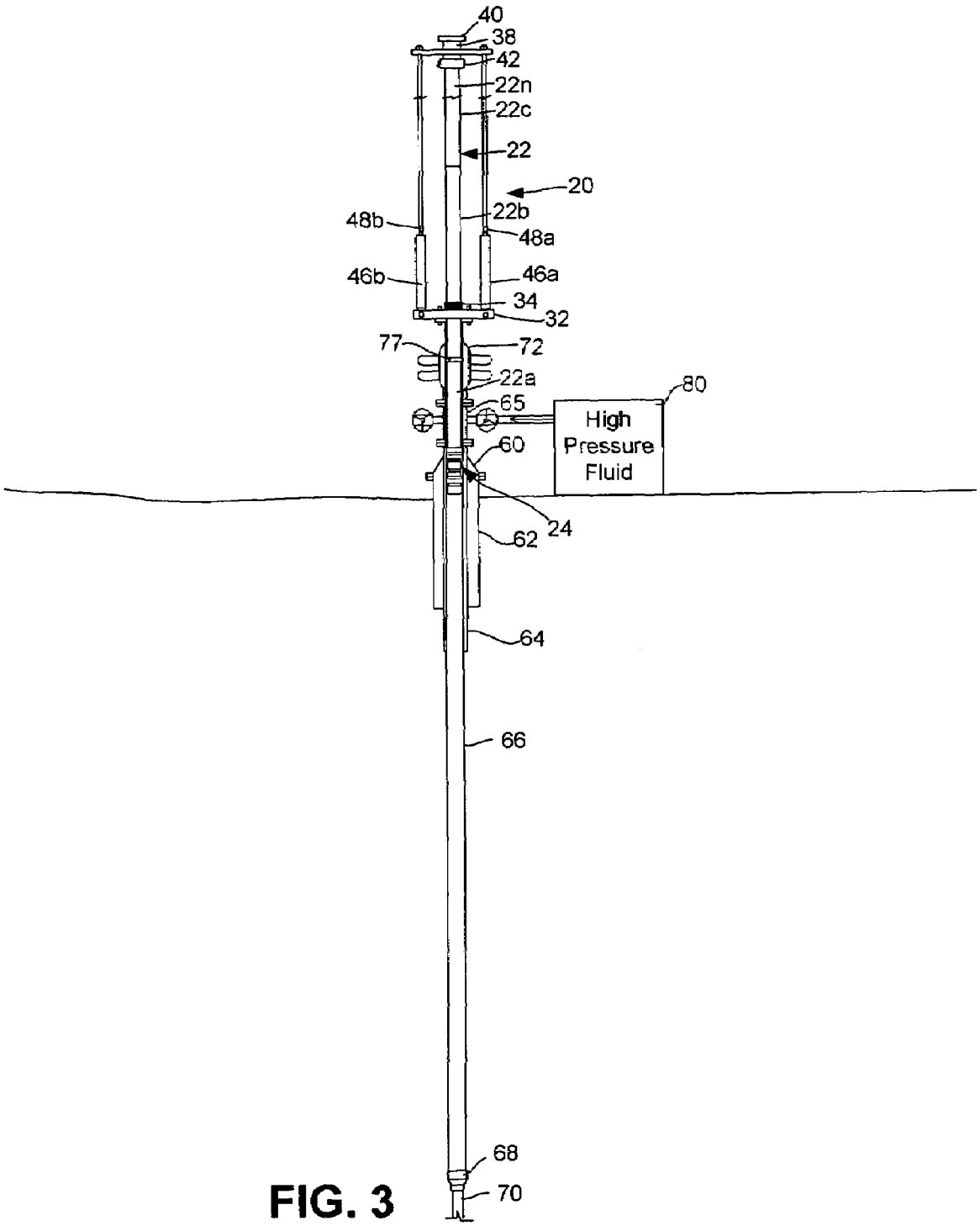
FIG. 3 is a schematic diagram of the subsurface lubricator shown in FIG. 2 after a lubricator tube of the subsurface lubricator has been lubricated into the cased well until a bi-directional packoff tool connected to a bottom end of the lubricator tube is in a top of a casing of the cased well.

FIG. 3 is a schematic diagram illustrating a first stage of a process of lubricating the lubricator tube 22 into the cased well. In the first stage, the blind rams 76 (see FIG. 2) of the BOP 72 are opened after appropriate pressure balancing, and the hydraulic cylinders 46*a*, 46*b* are operated to draw in the cylinder rods 48*a*, 48*b*. This lubricates the lubricator tube partially into the well so that the bidirectional packoff tool 24 passes through the BOP 72, the tubing head spool 65 and into a top of the casing 66. If the BOP is equipped with appropriately sized tubing rams, the tubing rams 77 may then be closed to provide a fluid seal around the lubricator tube 22. However, a high-pressure fluid seal is provided by the high-pressure packing 57 in the packing cavity 56 of the anchor plate 32, as described above with reference to FIG. 1.

Figure 4:
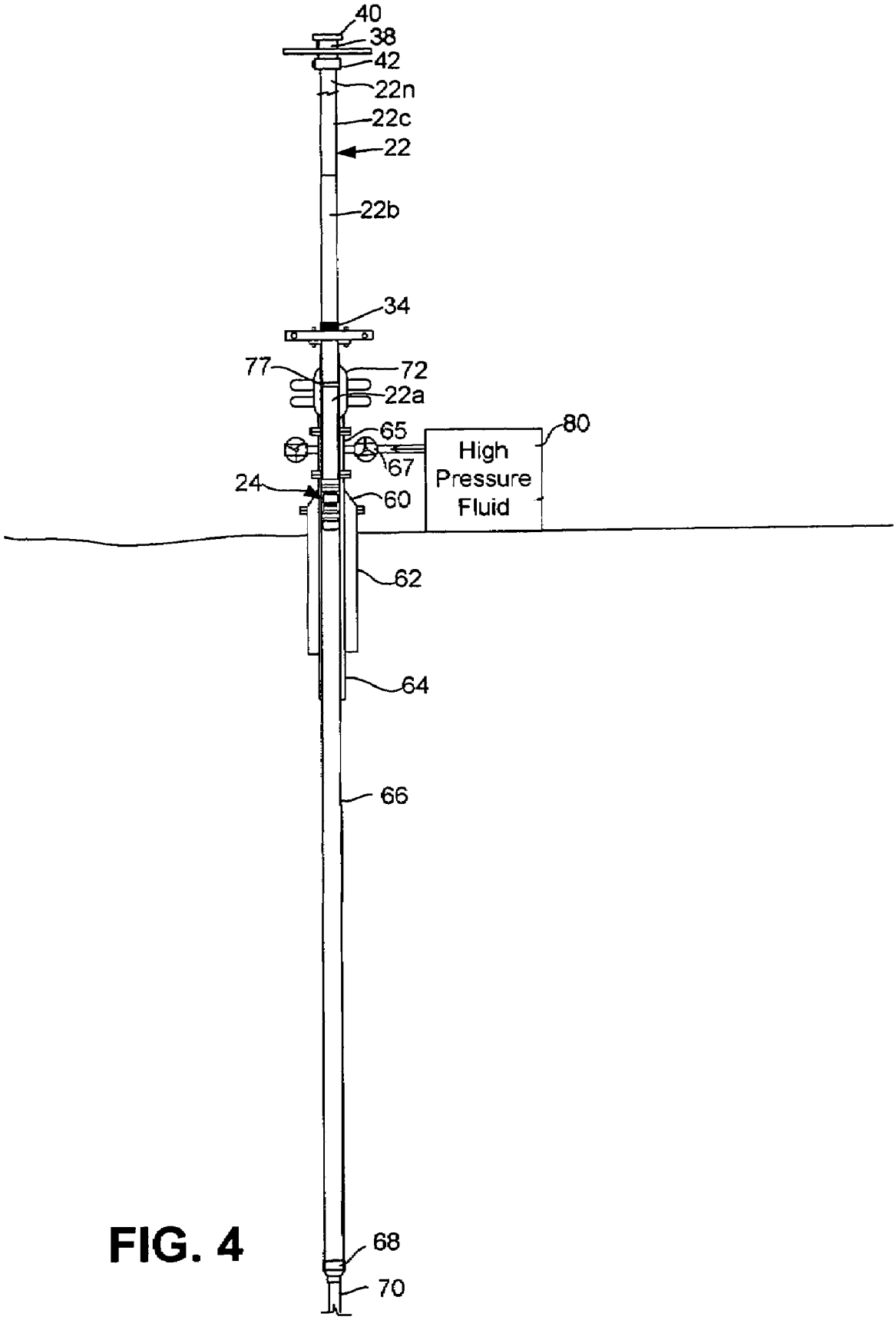
FIG. 4 is a schematic diagram of the subsurface lubricator shown in FIG. 3 with hydraulic cylinders removed.

FIG. 4 is a schematic diagram illustrating a second stage in the process of lubricating the lubricator tube 22 into the cased well. After the lubricator tube 22 has been lubricated into the well using the hydraulic cylinders 46*a*, 46*b* so that the bidirectional packoff tool 24 is in a top of the casing 66, a high pressure fluid source 80 is connected to a side port 67 of the tubing head spool 65, and high-pressure fluid is pumped or otherwise injected into an annulus above the bidirectional packoff tool 24 until the natural well pressure is overburdened and the hydraulic cylinders 46*a* and 46*b* as well as the hydraulic cylinder extensions 52*a* and 52*b* can be removed from the subsurface lubricator 20. The high-pressure fluid may be water, hydraulic fluid, compressed air, a compressed gas, or any other fluid that meets performance requirements as well as safety and environmental regulations. As will be understood by those skilled in the art, high-pressure fluid is trapped in the annulus between an upper sealing element of the bidirectional packoff tool 24 and the tubing rams 77 or the high-pressure packing 57. Once sufficient fluid pressure is injected, the trapped high-pressure fluid overbears well pressure and lubricates the lubricator tube 22 downwards into the casing.

Figure 5:
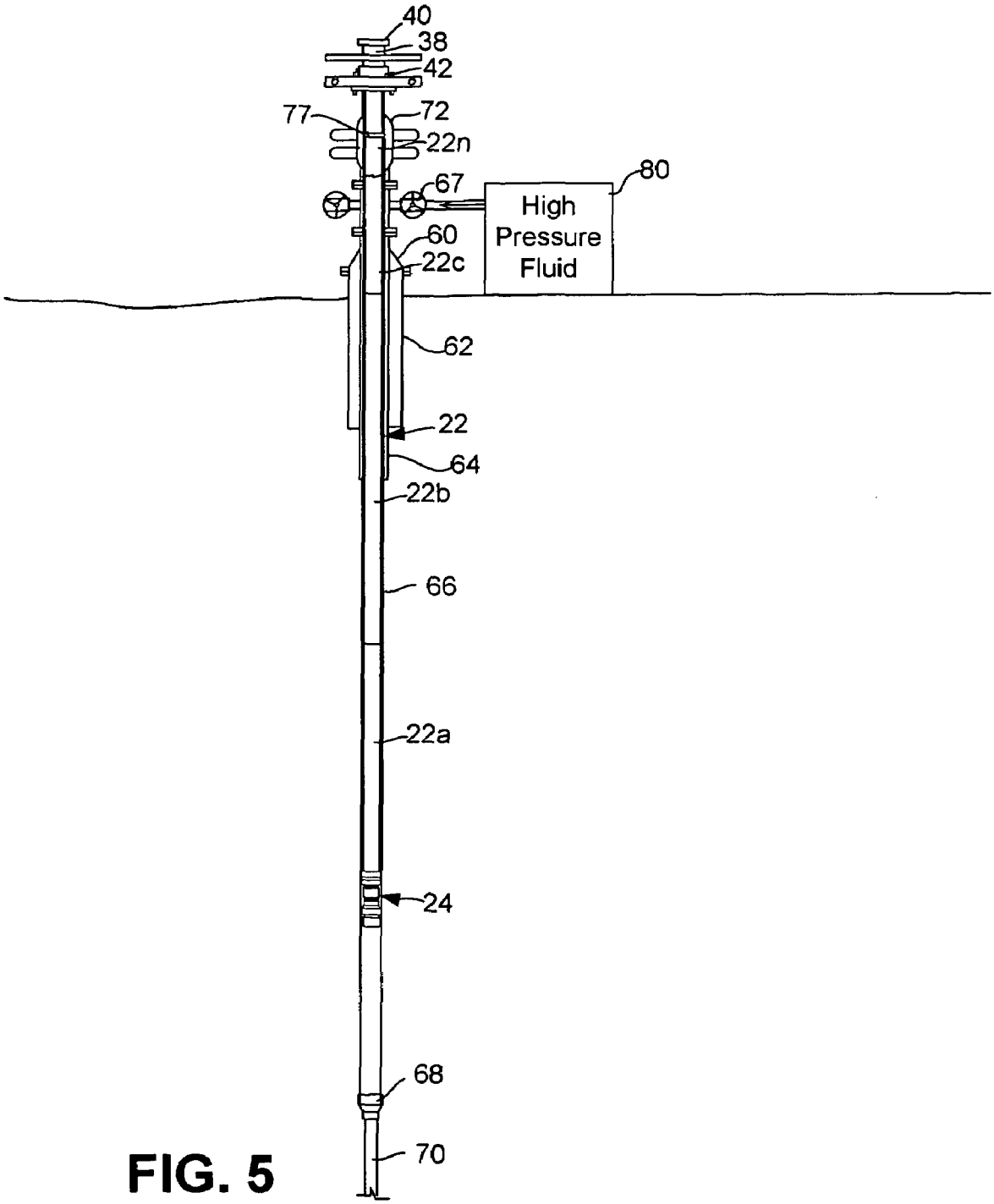
FIG. 5 is a schematic diagram of the subsurface lubricator shown in FIG. 4 in a fully lubricated-in position.

After the hydraulic cylinders 46*a*, 46*b* and the cylinder extension rods a 52*a*, 52*b* have been removed, the high-pressure fluid from the fluid source 80 is again pumped into the annulus above the bidirectional packoff tool 24 until of the lubricator tube 22 is fully lubricated into the cased well, as shown in FIG. 5. In this position the anchor nut 42 is threaded onto the anchor pin 34 (see FIG. 1) to lock the subsurface lubricator in the fully lubricated-in position. A valve on the side port 65 may then be closed and the downhole tool string housed in the lubricator tube 22 can be lowered into the cased well and manipulated to perform any of the functions for which it was designed.

Since the internal diameter of the lubricator tube 22 is at least as large as an internal diameter of the production casing 70, the subsurface lubricator 20 provides full-bore access to the cased wellbore. Well stimulation fluids can also be pumped down a coil tubing string (not shown) supporting the downhole tubing string, or "down the backside" through the lubricator tube 22. As will be explained below with reference to FIGS. 10 and 11, the bidirectional packoff tool 24 completely isolates the wellhead from high-pressure well stimulation fluids.

Figure 6:
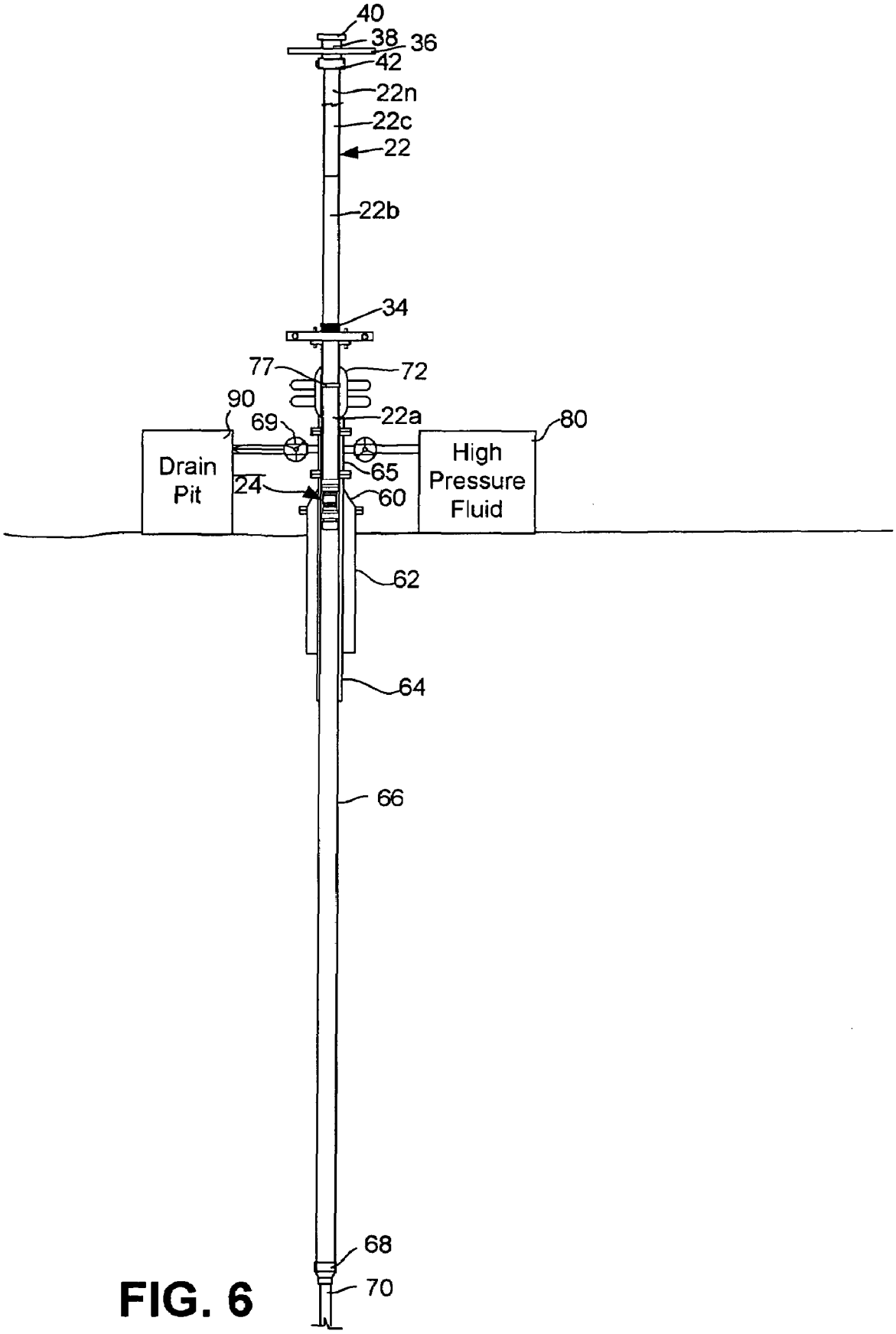
FIG. 6 is a schematic diagram of the subsurface lubricator after a well completion, re-completion or workover operation is completed and the subsurface lubricator has been partially lubricated out of the cased well.

After the downhole tool string has been used as planned, it is pulled back up into the lubricator tube by operating the coil tubing injector or the wireline grease injector (neither of which is shown), and the lubricator tube 22 is lubricated out of the cased well. FIG. 6 illustrates a first stage of lubricating the lubricator tube 22 out of the cased well. The process begins by connecting a line from a side port 69 of the tubing head spool 65 to a drain pit 90, or to any other suitable collection container, if required, so that the pressurized fluid used to lubricate in the lubricator tube 22 can be drained from the annulus above the bidirectional packoff tool 24. The anchor nut 42 is then rotated to release it from the anchor pin 34. A valve on the side port 69 is slowly opened to begin draining the pressurized fluid from the annulus. Assuming that the natural well pressure overbears the combined weight of the lubricator tube 22, the downhole tool string, and any equipment mounted to the adaptor 38, which is frequently the case, the lubricator tube 22 will begin to lubricate out of the well as soon as the side port 69 valve is opened. If that is not the case, a rig or a crane is connected to the injector plate 36 and the lubricator tube 22 is hoisted up to lubricate it out of the cased well.

Figure 7:
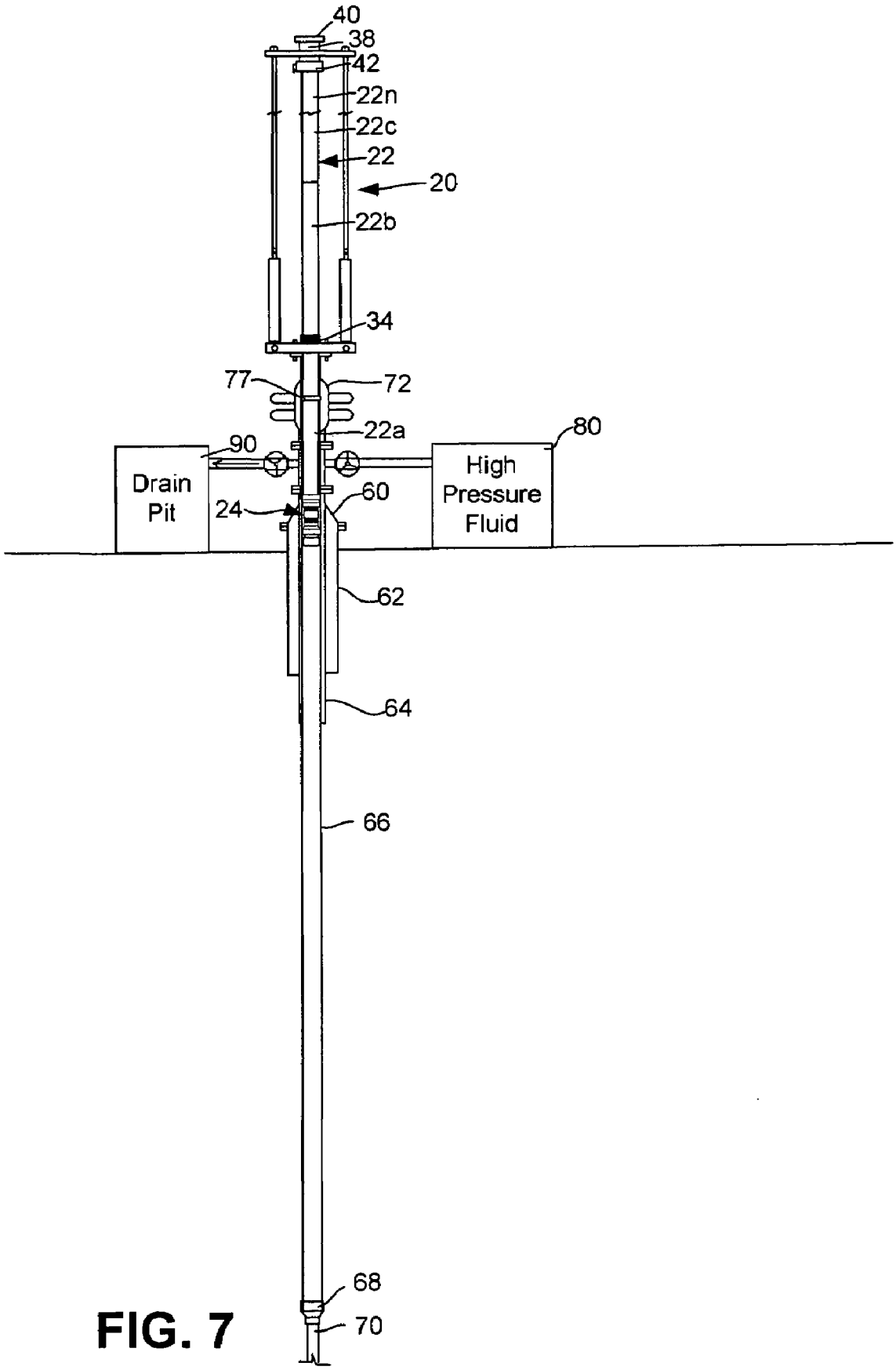
FIG. 7 is a schematic diagram of the subsurface lubricator shown in FIG. 6 with the hydraulic cylinders re-connected to permit the lubricator tube to be completely lubricated out of the cased well.
Figure 8:
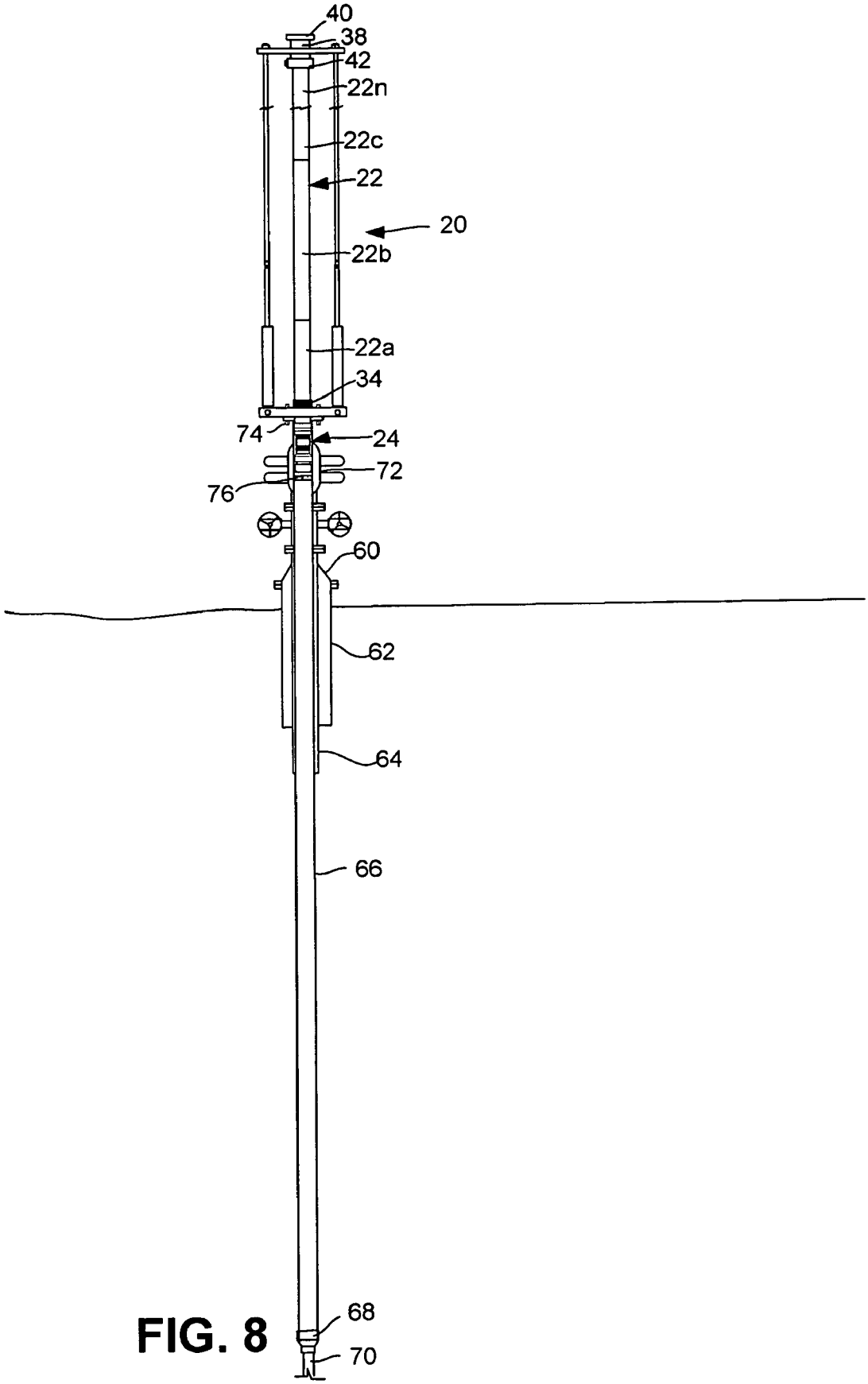
FIG. 8 is a schematic diagram of the subsurface lubricator shown in FIG. 4 in a completely lubricated-out position.

This lubrication of the lubricator tube 22 out of the cased well is permitted to continue until the lubricator tube 22 is returned to a position where the hydraulic cylinders 46*a* and 46*b* and the extension rods 52*a* and 52*b* can be reconnected, as shown in FIG. 7. The valve on the side port 69 is then closed until the hydraulic cylinders 46*a*, 46*b* and the extension rods 52*a*, 52*b* are re-connected. The valve on the side port 69 is then reopened and the hydraulic cylinders 46*a*, 46*b* are operated to lubricate out the lubricator tube 22 until a top the bidirectional packoff tool 24 is just below the side port 69. Any remaining high-pressure fluid is permitted to drain from the annulus and the valve on the side port 69 is then closed before the hydraulic cylinders 46*a*, 46*b* are used to lubricate the lubricator tube 22 to the position shown in FIG. 8. The blind rams 76 of the BOP 72 can then be closed and a rig or crane connected to a top of the subsurface lubricator 10 to support it while the flange bolts 74 are removed after pressure trapped above the blind rams 76 has been released in a manner well understood in the art. The subsurface lubricator 20 with the enclosed downhole tool string is then hoisted off of the wellhead by the rig or the crane, and preparations for production from the well can commence.

Figure 9:
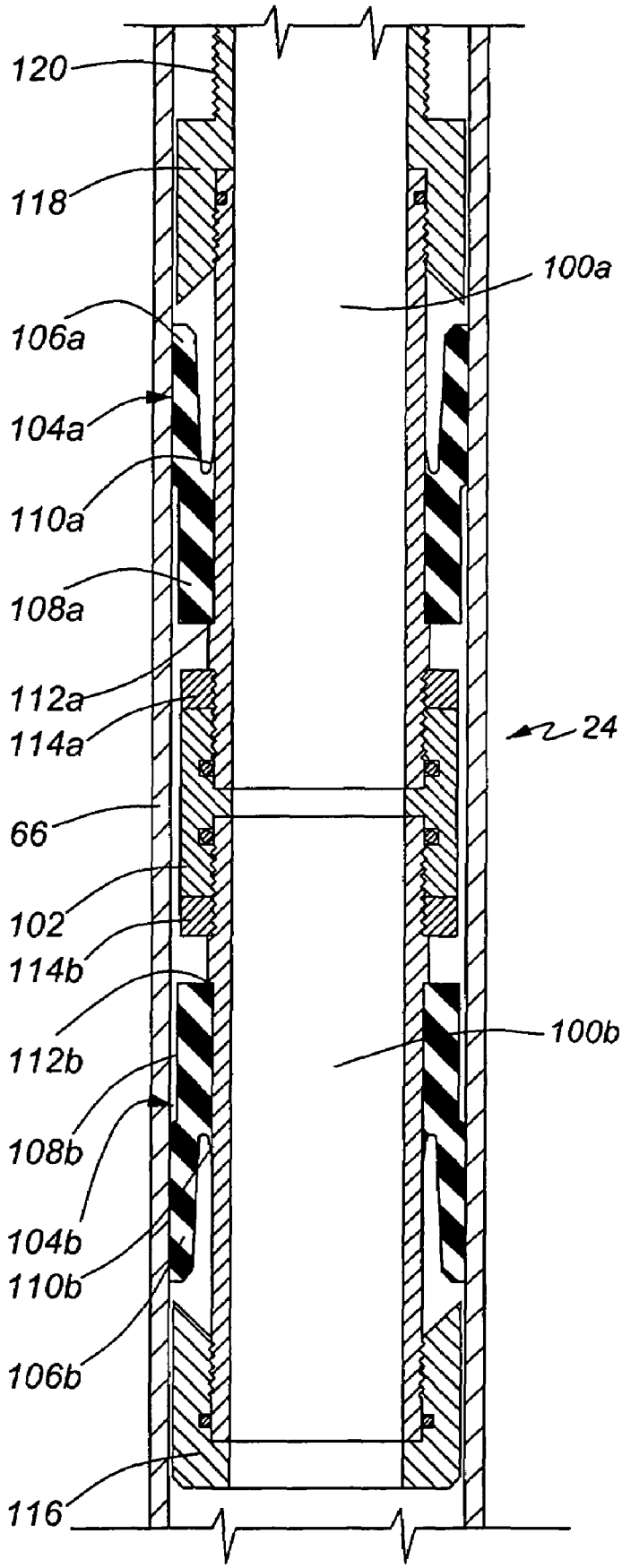
FIG. 9 is a cross-sectional schematic diagram of one embodiment of a bi-directional packoff tool in accordance with the invention.

FIG. 9 is a schematic cross-sectional view of one embodiment of the bidirectional packoff tool 24 shown in FIGS. 1-8. In this embodiment, the bidirectional packoff tool 24 is made up using cup tool mandrels 100*a* and 100*b*. The cup tool mandrels 100*a*, 100*b* can be interconnected in any orientation and in any sequence using threaded collars 102. The cup tool mandrels 100*a* and 100*b* have an internal diameter that is the same as that of the lubricator tube 22. Each cup tool mandrel 100*a* and 100*b* slidably supports an elastomeric cup 104*a* and 104*b*, which packs off in the casing 66 to provide required pressure isolation. Each elastomeric cup 104*a* and 104*b* includes a depending skirt 106*a*, 106*b*, which extends downwardly from a cup body 108*a*, 108*b* and is formed integrally therewith. The depending skirt 106*a*, 106*b* has an outer diameter that is slightly larger than the inner diameter of the casing 66. The depending skirt 106*a*, 106*b* is open at its bottom end, and forms a sealed cavity around the cup tool mandrels 100*a*, 100*b* that is closed at a top end by an inwardly biased lip 110*a*, 110*b*, so that when the elastomeric cup 104*a*, 104*b* is exposed to fluid pressure it is forced to slide away from the pressure on the respective cup tool mandrel 100*a*, 100*b*.

Movement of the elastomeric cups 104*a*, 104*b* on the respective cup tool mandrels 100*a*, 100*b* is constrained by a square step 112*a*, 112*b* which inhibits packoff of the elastomeric cups 104*a*, 104*b* when the bidirectional packoff tool is being lubricated through the wellhead and into the casing 66. The elastomeric cups 104*a*, 104*b* pack off against a respective gauge ring 114*a*, 114*b* to provide a high pressure fluid seal in a manner well known in the art.

As can be seen, the elastomeric cup 104*a* is oriented upwardly and provides the upper sealing element of the bidirectional packoff tool 24. It is the elastomeric cup 104*a* that traps the high pressure fluid from high-pressure fluid source 80 to lubricate the lubricator tube 22 down the casing 66. As can also be seen, the elastomeric cup 104*b* is oriented downwardly and packs off to isolate the wellhead 21 from well pressure as well as any high pressure fluids pumped into the casing 66 to stimulate production from the well.

A bullnose 116 guides the bidirectional packoff tool 24 through the wellhead and the casing 66 and protects the elastomeric cup 104*b* when the lubricator tube 22 is lubricated into or out of the well. An adapter sleeve 118 threadedly connected to a top of the cup tool mandrel 100*a* is similarly configured to protect the elastomeric cup 104*a*, and to provide a pin thread 120 for connecting the bidirectional packoff tool 24 to a box thread in a bottom end of the lubricator tube 22.

Figure 10:
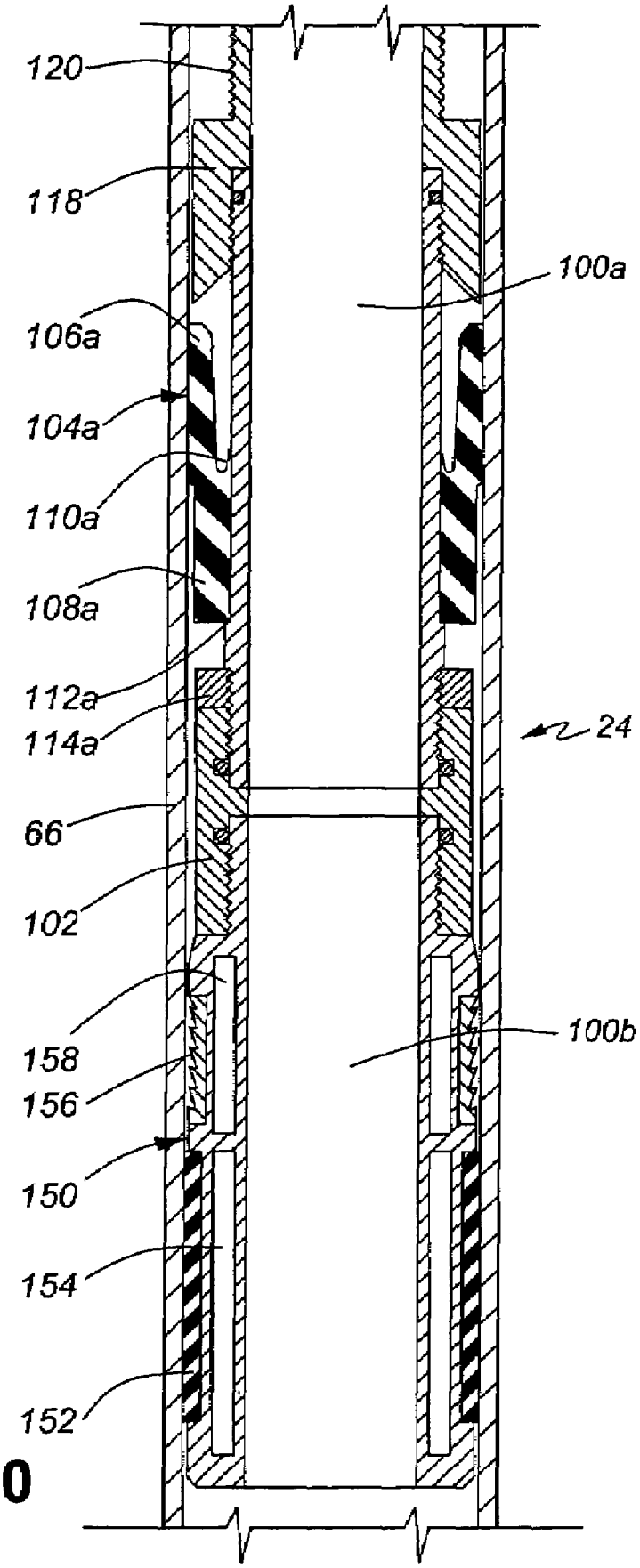
FIG. 10 is a cross-sectional schematic diagram of another embodiment of the bi-directional packoff tool in accordance with the invention.

FIG. 10 is a schematic diagram of another embodiment of the bidirectional packoff tool 24 shown in FIGS. 1-8. This embodiment permits the lubricator tube to be locked in the casing to reduce lifting stress on the wellhead 21 when high pressure fluids are pumped through coil tubing or down the backside through the lubricator tube 22 to stimulate production from the well.

As shown in FIG. 11, a top half of the bidirectional packoff tool 24 is identical to that described above with reference to FIG. 10, and will not be redundantly described. A bottom half of the bidirectional packoff tool 24 is a casing packer 150, many configurations of which are well known in the art. The casing packer 150 includes an annular packer element 152, which when activated by internal mechanisms 154 (schematically shown) packs off against the casing 66 to provide a high pressure fluid seal. There are many different packer elements known in the art and many types of internal mechanism for controlling them.

The casing packer 150 also includes casing-engaging slips 156, which are extended to a casing-engaging position in which they bite into the casing 66 to prevent upward movement of the bidirectional packoff tool 24 when the casing packer 150 is set. Internal mechanisms 158 (schematically shown), many configurations of which are also well known in the art, move the casing-engaging slips 150 from the casing-engaging position to an unset position in which the lubricator tube 22 can be withdrawn from the casing 66.

It should be understood that the bidirectional packoff tool 24 can be constructed using any known cup tool, packoff nipple or casing packer technology and that the invention is not limited to the two embodiments described with reference to FIGS. 9 and 10.

It should also be understood that the hydraulic cylinders 46*a*, 46*b* described with reference to FIGS. 1-8 could be replaced with pneumatic cylinders, ball jacks, screw jacks, or any other robust mechanism for inducing controlled linear movement that can be used to lubricate the lubricator tube 22 into the well until the bidirectional packoff tool 24 is lubricated into a top of the casing 66.

The embodiments of the invention described above are therefore intended to be exemplary only, and the scope of the invention is intended to be limited solely by the scope of the appended claims.

I claim:

1. A subsurface lubricator for lubricating a long tool string into a cased wellbore, comprising:

a lubricator tube for housing the long tool string, the lubricator tube having a top end connected to an adapter flange which permits any compatible flanged component to be mounted to the top end of the subsurface lubricator, an injector plate connected to the adaptor flange in a radial orientation and a bottom end;

a bidirectional packoff tool connected to the bottom end of the lubricator tube, the bidirectional packoff comprising a central passage with an internal diameter that is the same as an internal diameter of the lubricator tube, an upwardly oriented upper sealing element that traps pressurized fluid injected into an annulus between a casing of the cased wellbore and the lubricator tube, and a lower sealing element between the upper sealing element and a bottom end of the bidirectional packoff tool, the lower sealing element isolating a wellhead of the cased wellbore from fluid pressure in the cased wellbore below the bottom end of the bidirectional packoff tool; and a mechanism that induces controlled linear motion of the lubricator tube to lubricate the lubricator tube through the wellhead of the cased wellbore so that the bidirectional packoff tool is located in a top of the casing of the cased wellbore, in which location pressurized fluid can be supplied through a port of the wellhead to lubricate the lubricator tube further into the casing by applying fluid pressure to the upper sealing element of the bidirectional packoff tool.

2. The subsurface lubricator as claimed in claim 1 further comprising an anchor plate for anchoring the subsurface lubricator to the wellhead of the cased wellbore, the anchor plate comprising:

a central passage through which the lubricator tube reciprocates;

an anchor pin surrounding the central passage, the anchor pin including a pin thread on an outer periphery thereof;

a packing cavity within the central passage and the anchor pin, the packing cavity receiving high pressure packing to provide a high pressure fluid seal around the lubricator tube; and connection points for the mechanism that induces the controlled linear motion.

3. The subsurface lubricator as claimed in claim 2 further comprising a lubricator tube adaptor connected to the top end of the lubricator tube, the lubricator tube adaptor including a central passage that communicates with an interior of the lubricator tube, an adaptor flange for supporting equipment for controlling the long tool string and an injector plate having connection points for the mechanism that induces the controlled linear motion.

4. The subsurface lubricator as claimed in claim 1 wherein the bidirectional packoff tool comprises first and second cup tool mandrels connected together by a threaded collar, the first cup tool mandrel slidably supporting the upwardly oriented upper sealing element, which comprises an elastomeric cup having the open end oriented upwardly that packs off in the casing to provide fluid pressure isolation above the bidirectional packoff tool, and the second cup tool mandrel slidably supporting the lower sealing element which comprises an elastomeric cup having an open end that is downwardly oriented and packs off in the casing to isolate the wellhead of the cased wellbore from the fluid pressure in the cased wellbore below the bottom end of the bidirectional packoff tool.

5. The subsurface lubricator as claimed in claim 1 wherein the bidirectional packoff tool comprises a cup tool mandrel connected to a casing packer, the cup tool mandrel slidably supporting the upwardly oriented upper sealing element which comprises an elastomeric cup having the open end oriented upwardly, which packs off in the casing to provide fluid pressure isolation above the bidirectional packoff tool, and the lower sealing element comprises the casing packer which packs off in the casing to isolate the wellhead of the cased wellbore from the fluid pressure in the cased wellbore below the bottom end of the bidirectional packoff tool.

6. The subsurface lubricator as claimed in claim 5 wherein the casing packer further comprises casing-engaging slips that controllably engage the casing to releasably lock the lubricator tube in the casing.

7. The subsurface lubricator as claimed in claim 3 wherein the mechanism for inducing controlled linear motion comprises hydraulic cylinders.

8. The subsurface lubricator as claimed in claim 7 further comprising extension rods for connecting cylinder rods of the hydraulic cylinders to the injector plate connected to the top end of the lubricator tube.

9. A method of lubricating a downhole tool string into a cased wellbore, comprising:

mounting a subsurface lubricator with a lubricator tube above a pressure control gate mounted to a wellhead of the cased wellbore, the lubricator tube having a top end with an adapter flange and a bottom end connected to a bidirectional packoff tool, the lubricator tube housing the downhole tool string and the bidirectional packoff tool having an internal diameter at least as large as an internal diameter of the lubricator tube to permit the downhole tool string to be lowered from the lubricator tube through the bidirectional packoff tool into the cased wellbore;

opening the pressure control gate and lubricating the lubricator tube through the wellhead until the bidirectional packoff tool connected to the bottom end of the lubricator tube is located in a top of a casing of the cased wellbore, the bidirectional packoff tool comprising an upper sealing element with an open end oriented upwardly towards the top end of the lubricator tube to trap pressurized fluid injected into an annulus between the casing and the lubricator tube and a lower sealing element between the upper sealing element and the bottom end of the bidirectional packoff tool to isolate a wellhead of the cased wellbore from fluid pressure in the cased wellbore below the bottom end of the bidirectional packoff tool; and injecting pressurized fluid through the wellhead into the annulus above the bidirectional packoff tool to lubricate the lubricator tube further into the casing.

10. The method as claimed in claim 9 further comprising locking the lubricator tube to an anchor plate of the subsurface lubricator using an anchor nut supported by a lubricator tube adaptor connected to the top end of the lubricator tube, after the lubricator tube has been lubricated further into the casing.

11. The method as claimed in claim 9 wherein lubricating the lubricator tube through the wellhead until the bidirectional packoff tool connected to the bottom end of the lubricator tube is located in the top of the casing comprises operating hydraulic cylinders to lubricate in the lubricator tube.

12. The method as claimed in claim 11 wherein prior to lubricating the lubricator tube through the wellhead, the method further comprises connecting cylinder rods of the hydraulic cylinders to an injector plate connected to the top end of the lubricator tube using extension rods connected between cylinder rod ends of the hydraulic cylinders and the injector plate.

13. The method as claimed in claim 9 further comprising lowering the downhole tool string through the lubricator tube and the bidirectional packoff tool and into the casing of the cased well performing downhole operations using the downhole tool string; and lubricating the lubricator tube out of the wellhead after using the downhole tool string to perform downhole operations.

14. The method as claimed in claim 13 wherein lubricating the lubricator tube out of the wellhead comprises a first stage of connecting a drain line to a side port of the wellhead and opening a valve of the side port to release part of the pressurized fluid from the annulus.

15. The method as claimed in claim 14 further comprising a second stage that comprises:

closing the valve of the side port and connecting hydraulic cylinders to an injector plate connected to the top end of the lubricator tube;

opening the valve of the side port and operating the hydraulic cylinders to lubricate the lubricator tube out of the wellhead until the bidirectional packoff tool is just below the side valve;

stopping the lubricator tube to permit the pressurized fluid to drain from the wellhead;

closing the valve of the side port and lubricating the lubricator tube out of the wellhead using the hydraulic cylinders;

closing the pressure control gate mounted above the wellhead; and removing the subsurface lubricator from the wellhead.

16. A subsurface lubricator for lubricating a long tool string into a cased wellbore, comprising:

a lubricator tube for housing the long tool string, the lubricator tube having a top end and a bottom end;

a bidirectional packoff tool connected to the bottom end of the lubricator tube, the bidirectional packoff tool having an internal passage with an internal diameter at least as large as an internal diameter of the lubricator tube to permit the long tool string to be lowered through the bidirectional packoff tool into the cased wellbore and further having an upper sealing element with an open end oriented upwardly towards the top end of the lubricator tube to trap pressurized fluid injected into an annulus between a casing of the cased wellbore and the lubricator tube and a lower sealing element between the upper sealing element and the bottom end of the bidirectional packoff tool to isolate a wellhead of the cased wellbore from fluid pressure in the cased wellbore below a bottom end of the bidirectional packoff tool; and hydraulic cylinders for lubricating the lubricator tube through the wellhead of the cased wellbore until the bidirectional packoff tool is located in a top of the casing of the cased wellbore, in which location pressurized fluid can be supplied through a port of the wellhead to the annulus above the bidirectional packoff tool to lubricate the lubricator tube further into the casing.

17. The subsurface lubricator as claimed in claim 16 further comprising an anchor plate for mounting the lubricator tube to the wellhead, the anchor plate comprising:

a central passage through which the lubricator tube reciprocates;

a packing cavity surrounding the central passage, the packing cavity accepting high pressure packing that provides a high-pressure fluid seal around the lubricator tube; and connection points for the hydraulic cylinders.

18. The subsurface lubricator as claimed in claim 16 further comprising a lubricator tube adaptor connected to the top end of the lubricator tube, the lubricator tube adaptor comprising:

a flange for supporting equipment for controlling the downhole tubing string;

an annular shoulder for rotatably supporting an anchor nut for locking the lubricator tube to the anchor plate; and an injector plate having connection points for the hydraulic cylinders.

19. The subsurface lubricator as claimed in claim 16 wherein the bidirectional packoff tool comprises first and second cup tool mandrels connected together, the first cup tool mandrel supporting the upwardly oriented upper sealing element which comprises an elastomeric cup that traps the pressurized fluid injected into the annulus, and the second cup tool mandrel supporting the lower sealing element which comprises a downwardly oriented elastomeric cup that isolates the wellhead from fluid pressure in the cased wellbore.

20. The subsurface lubricator as claimed in claim 16 wherein the lubricator tube comprises a plurality of lubricator joints connected end-to-end to provide an elongated lubricator tube having smooth cylindrical inner and outer surfaces.

* * * * *